United States Patent [19]

Schnelle et al.

[11] 3,952,367

[45] Apr. 27, 1976

[54] STABILIZING HINGE FOR FURNITURE WITH GLASS DOORS

[75] Inventors: Manfred Schnelle, Hiddenhausen; Ernst Zernig, Hemer; Jürgen Wilke, Bunde, all of Germany

[73] Assignee: Firma Richard Heinze, Herford, Germany

[22] Filed: Sept. 19, 1974

[21] Appl. No.: 507,513

[30] Foreign Application Priority Data

Sept. 20, 1973 Germany ..... 2347290
June 14, 1974 Germany ..... 2428749

[52] U.S. Cl. ..... 16/147; 16/180; 16/191

[51] Int. Cl.[2] ..... E04D 15/50

[58] Field of Search ..... 16/128 R, 139, 142, 16/180, DIG. 10, DIG. 17, 141, 144, 145, 128.1, 147, 148, 182, 187, 191

[56] References Cited

UNITED STATES PATENTS

| | | | |
|---|---|---|---|
| 991,026 | 5/1911 | Rodenbeck | 16/142 |
| 2,743,476 | 5/1956 | Turner | 16/141 |
| 3,414,933 | 12/1968 | Gronbach | 16/180 |
| 3,605,174 | 9/1971 | Marchione | 16/145 |
| 3,833,964 | 9/1974 | Harcourt | 16/145 |

FOREIGN PATENTS OR APPLICATIONS

| | | | |
|---|---|---|---|
| 107,536 | 6/1967 | Denmark | 16/128.1 |
| 608,290 | 11/1960 | Canada | 16/139 |
| 1,050,652 | 12/1966 | United Kingdom | 16/145 |

*Primary Examiner*—George H. Krizmanich
*Attorney, Agent, or Firm*—Pollock, Vande Sande & Priddy

[57] ABSTRACT

A hinge for pivotally supporting a glass door to a furniture part or the like. The hinge comprises a housing which fits within a mating through aperture in the door. The housing is provided with a peripheral flange which abuts one surface of the door adjacent to the recess therein and also has a clamping means detachably secured thereto which abuts the opposite surface of the door so that the housing can be tightly secured to the glass door. A generally L-shaped hinge arm is provided which is secured to the furniture part and which defines therein a hollow interior portion. The hinge arm is pivotally mounted to the housing. A latch member within the interior portion of the hinge arm is pivotally supported therein, and a spring resiliently urges the latch in a direction to engage with an abutment on the housing when the glass door is moved to its closed position.

5 Claims, 16 Drawing Figures

Figure 4:
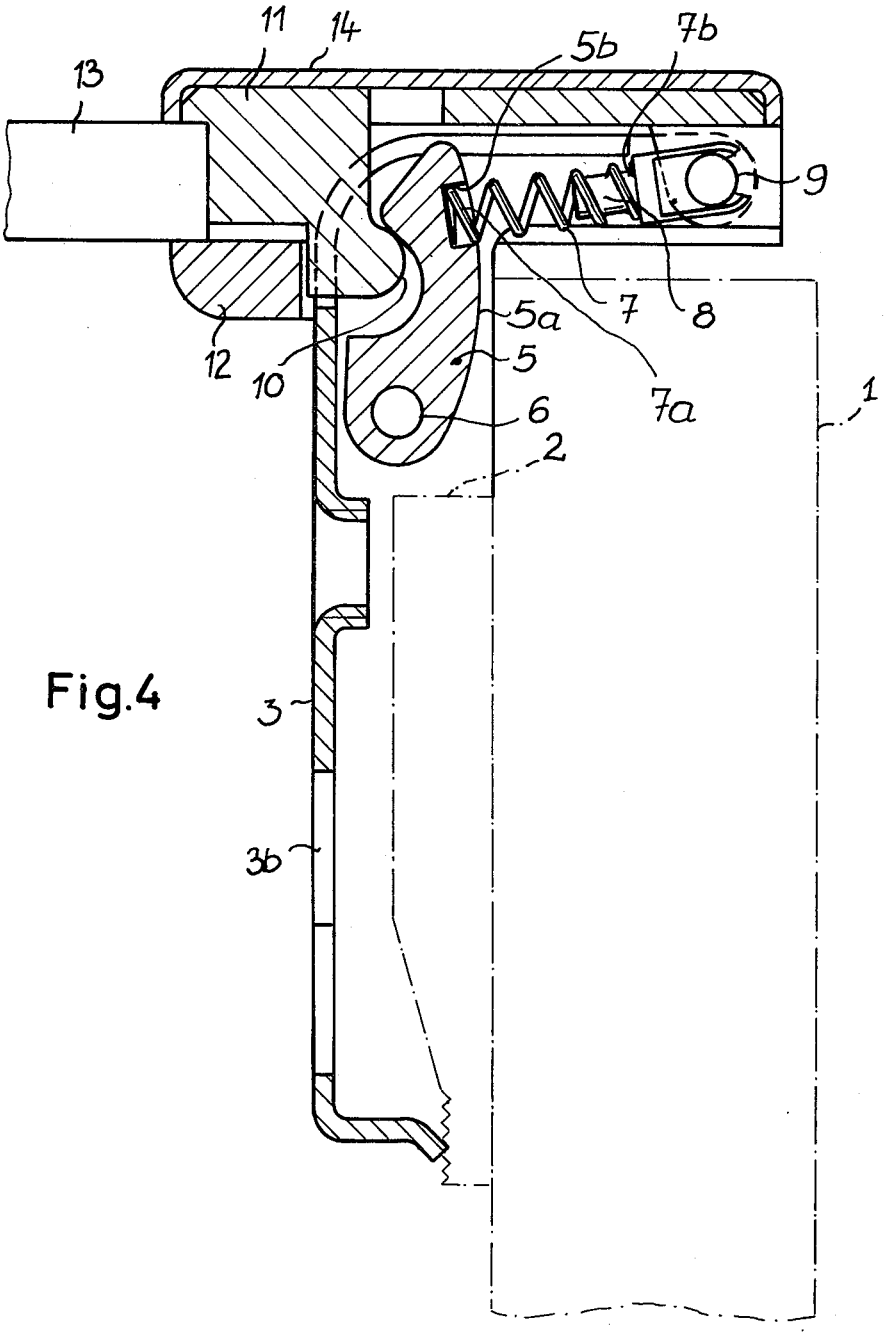

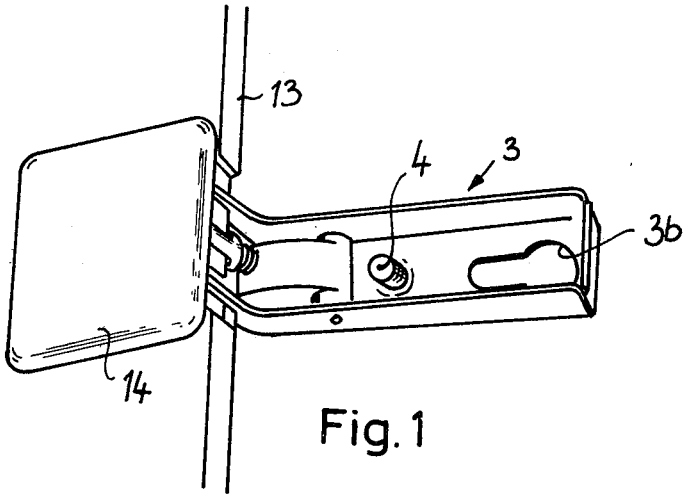
Fig. 1
Fig. 2
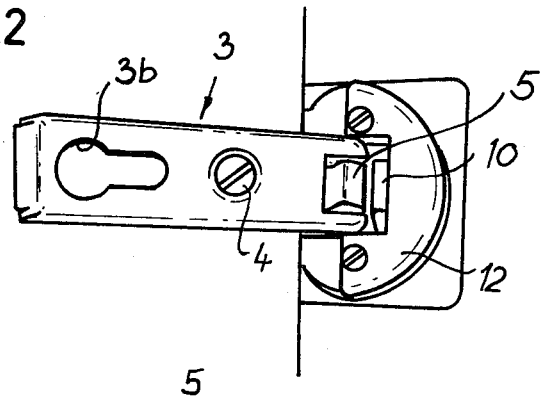
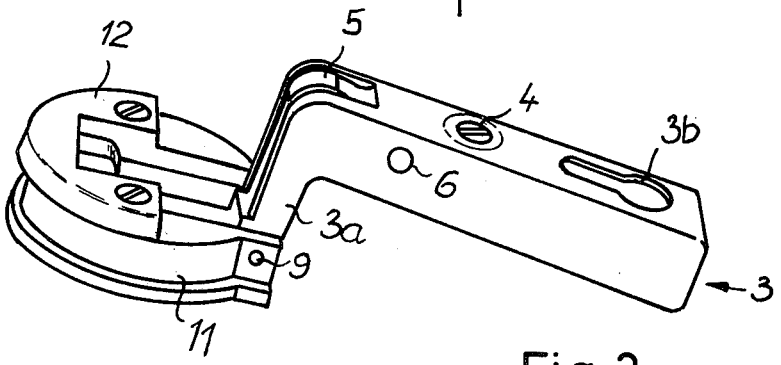
Fig. 3

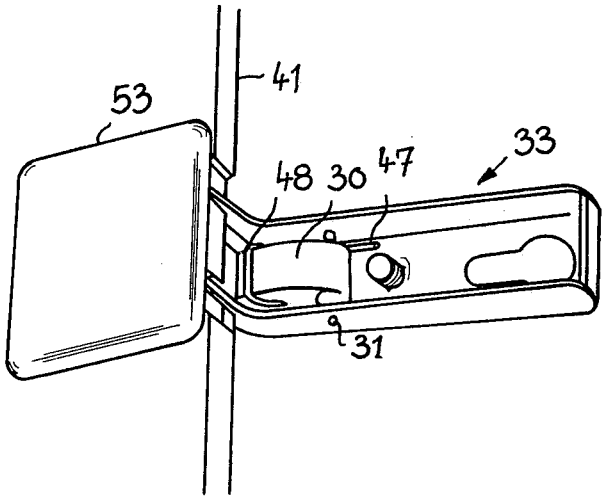
Fig.5
Fig.6
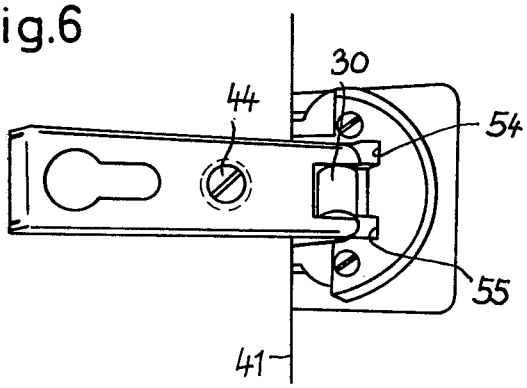
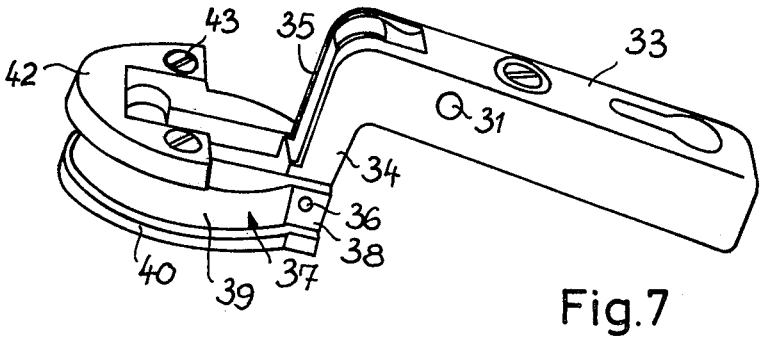
Fig.7

Fig.16
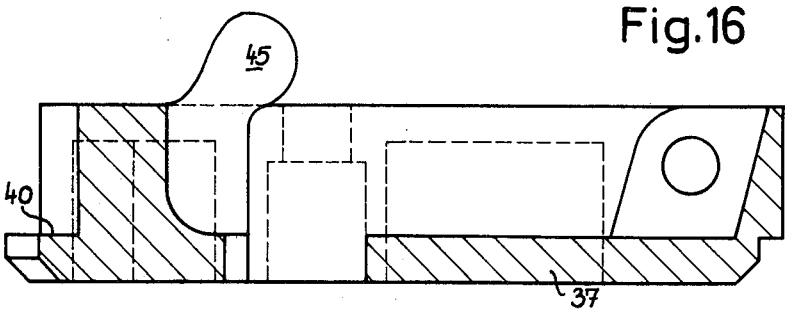
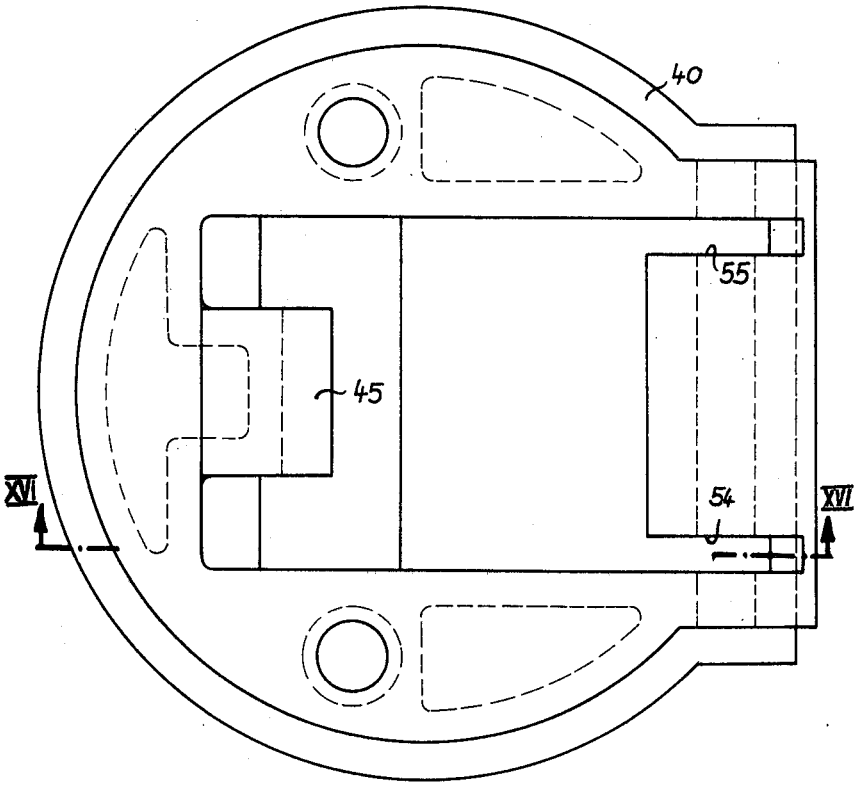
Fig. 15

STABILIZING HINGE FOR FURNITURE WITH GLASS DOORS

The invention concerns a stabilizing hinge for furniture with glass doors, having a hinge arm secured to the furniture body, and a housing secured in an aperture in the glass door. A spring-loaded latch element is provided in the hinge which cooperates with a latch element in an opposing part arranged on the housing. The hinge arm and housing are pivotally connected by means of a pivot pin.

In a known hinge of this type, the latch element takes the form of a spring-loaded snapper which is slideably located in an elongated recess. This guide channel for the snapper is ranged in an extension of the hinge arm which extends over the front edge of the furniture side wall. The opposing part, which cooperates with the latch element, takes the form of a roller with its axis parallel to the edge of the door and to the hinge pivot. The main disadvantage of this known construction is that it is relatively complicated and subsequently expensive.

The present invention comprises an improvement of the prior art hinge of the first mentioned type, thereby providing a hinge which is of simple construction, inexpensive to manufacture, and yet functions reliably.

According to the present invention, the latch element which is pivotally mounted within the hollow hinge arm, engages an abutment which is integrally formed with the housing, when the hinge is in the closed position.

Such a construction is extremely simple and saves space. Thus, the spring can be arranged within the hinge arm, and need not be situated in the housing which is necessarily thin when used for glass doors. The housing of a glass-door hinge does not provide sufficient space for the spring.

In a preferred embodiment, the latch element is biased by means of a hairpin spring, the base of which fits over the back of the latch, and the legs of which abut the inside surface of the hollow hinge arm. With such a solution, the spring is compactly located within the hinge arm. Securing means for the hairpin spring are not needed since the U-shaped cross-section of the hinge arm provides adequate support.

In another embodiment, the pivotally mounted latch is biased by means of a spiral compression spring, the first end of which is pivotally connected to a pivot pin, and the second end of which abuts the back of the latch. The spring in this embodiment is supported in the angled end of the L-shaped hinge arm where space is available to accomodate such spring. Mounting the pressure spring on the pivot pin of the housing and hinge arm ensures that the retaining power of the spring remains constant in all hinge positions. A relatively simple method of influencing the closing and retaining behaviour of the hinge is achieved by shaping the curve of the latch point and/or the abutment accordingly.

According to the latter-mentioned embodiment, a first end of the spiral spring encloses a guide pin which is mounted perpendicularly on the hinge pivot pin. In this case, it is of advantage to provide the guide pin with a forked, end, that is, a bore open at one side, for straddling the pivot pin. In this way, the assembly of parts is simplified, since the guide pin need not be threaded onto the pivot pin as would be the case if only a bore were provided.

It is further proposed that the second end of the spiral spring be located in a recess of corresponding diameter on the back of the latch. Therefore, consequently, both ends of the spring are securely mounted. Also, it is desirable to make the guide pin of sufficient length to prevent the spring from snapping sideways.

In the following a preferred embodiment of the invention is described in detail with the aid of the drawings which show:

FIG. 1 a perspective view of the hinge arm and neighbouring zones, as seen from below.

FIG. 2 a perspective view of the hinge in a near closed condition.

FIG. 3 a perspective side view of the hinge.

FIG. 4 a sectional view through the length of the hinge according to FIGS. 1 to 3

FIGS. 5–8 views corresponding generally to FIGS. 1 to 4 but directed to a second alternative embodiment.

Figure 9:
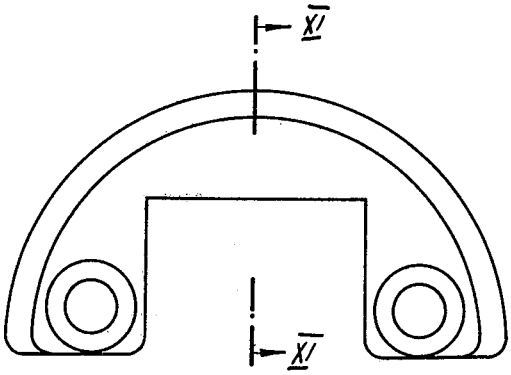

FIG. 9 a plan view of a clamping plate which is the same for both embodiments.

Figure 10:
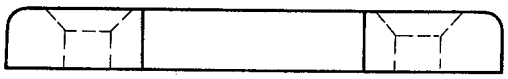

FIG. 10 a side view of the clamping plate according to FIG. 9.

Figure 11:
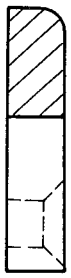

FIG. 11 a section along the line XI—XI in FIG. 9

Figure 12:
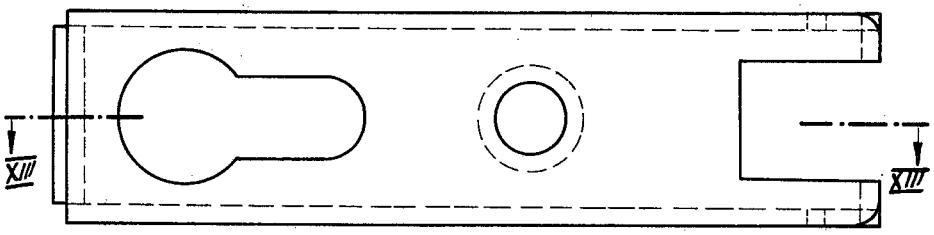

FIG. 12 a plan view of the hinge arm common to both embodiments.

Figure 13:
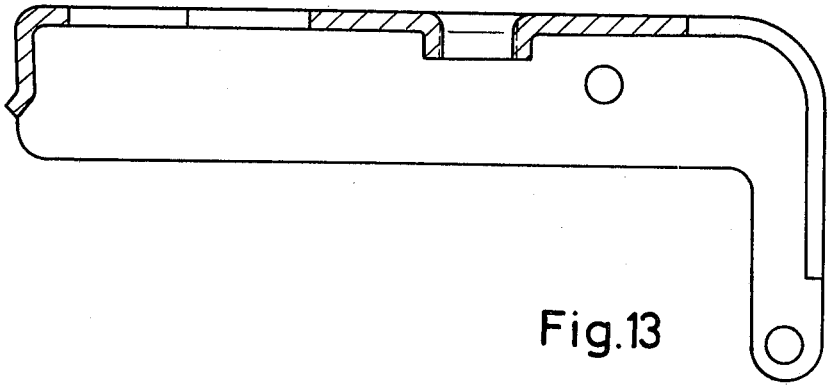

FIG. 13 a section along the line XIII—XIII in FIG. 12.

Figure 14:
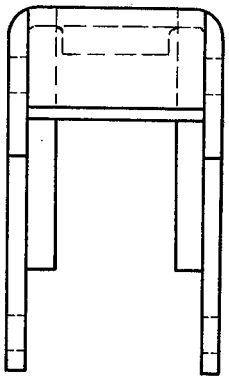

FIG. 14 a view from the rear of the hinge arm according to FIGS. 12 and 13.

FIG. 15 a plan view of the housing without the clamping plate and other parts.

FIG. 16 a section through the housing along the line XVI—XVI in FIG. 15

Referring to the embodiment according to FIGS. 1 to 5, a base plate 2, shown in broken lines, is arranged on a furniture sidewall 1, also shown in broken lines (see FIG. 4). Secured over the base plate 2 is the body of a substantially L-shaped hinge arm 3. The hinge arm is in a well known manner of U-shaped cross-section. In assembled condition, the body of the L-shaped hinge arm 3 is secured in a known manner over the base plate 2. The base plate is screwed with its own screws to the furniture sidewall. The hinge arm 3 is screwed securely to the base plate 2 by means of a screw (not shown) which passes through the keyhole shaped aperture **3*b*. Adjustment of the hinge arm takes place with the aid of the height adjusting screw 4 which abuts the base plate 2**.

A latch 5 is carried on a pin 6 which is secured in the sidewalls of the hinge arm 3. The back **5*a* of the latch 5 is provided with a recess 5*b*, the circumference of which corresponds to that of the spiral compression spring 7. The first end 7*b* of the spring 7 is fitted over a guide pin 8, which forms a guide for the spring 7 and prevents it from snapping sideways when it is compressed. The guide pin 8 has a forked end which straddles the pivot arm 9 for pivotal movement. Assembly of the furniture hinge is simplified by the fact that the guide pin does not need to be threaded onto the pivot pin 9. The second end 7*a* of the spiral spring 7 is fitted into the recess 5*b* on the back 5*a*** of the latch.

In the closed position of the hinge, the latch 5 locates behind the abutment 10, which is integrally moulded with the lower or outer part of the preferably plastic housing 11. The glass door 13 is clamped between the rim of the housing 11 and the clamping plate 12. A metal cap 14 serves as a decorative cover for the hinge housing 11. When the door 13 is opened by clockwise rotation about pivot 9, the abutment 10 moves out of the recess formed in latch 5.

The pivot 9, which is carried in the housing 11, bears not only the guide pin 8 but also the end 3*a* of the L-shaped hinge arm 3.

Referring now to FIGS. 5 to 16, the basic construction of the hinge of this alternative embodiment corresponds to that of the hinge according to FIGS. 1 to 4. However, the construction of the spring element which biases the pivoted latch is different in this alternative form of the invention.

Figure 8:
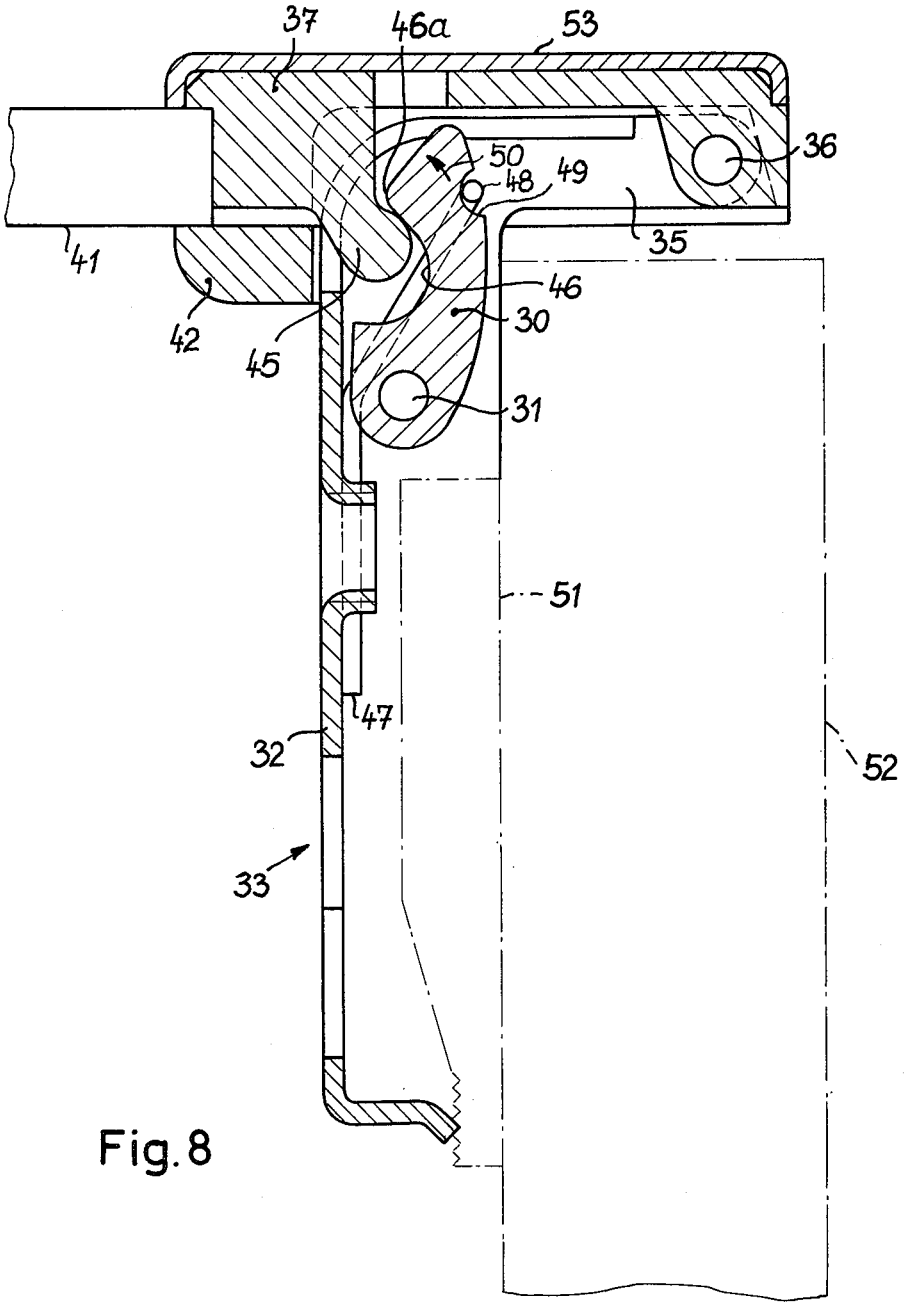

The base plate 51 shown in FIG. 8 is secured to a furniture sidewall 52. The U-section body 32 of an L-shaped hinge arm is fitted over the base plate 51. The base end of the L-shaped hinge arm comprises sidewalls 34 and 35 which are pivotally supported on shaft 36. The hinge housing 37 (FIG. 7) is pivoted by means of the shaft 36 to the hinge arm 33. The shaft 36 is located in the portion 38 of housing 37.

Next to the straight-edged zone 38 of the housing 37 is a circular zone 39. The circular zone 39 has a rim 40. This rim 40 overlies the edge of the receiving aperture in the glass door, into which the housing is fitted, on the outside of the door 41. A clamping plate 42 on the inside, is secured to the housing with screws 43. In assembled condition, the glass door is securely clamped between the rim 40 and the clamping plate 42. An integrally formed abutment 45 protrudes out of the housing 37. The latch 30 receives abutment 45 within its recess 46, with the nose 46a of the latch locating behind the abutment 45 in the closed position of the hinge. The latch 3*c* is pivoted to the U-section body of the hinge arm 33 by means of a pivot pin 31.

A hairpin spring is arranged with its base 48 in a recess 49 formed in the back of the latch 3*o*.

The hairpin spring 47, operating in the manner of a leaf spring, urges the latch 3*o* continually in the direction of the arrow 5o. The pressure of the spring 47 is overcome and the latch pivots in the opposite direction of the arrow 5o when the latch 3*o* and the node 45 come into contact as the doow is opened by clockwise rotation about pivot 36 and also when the door is operated to its closed position as shown in FIG. 8.

A metal cap 53 is provided on the front of the glass door to cover the housing 37.

What we claim is:

1. A hinge for pivotally supporting a glass door to a furniture part or the like and comprising:

housing means fitting within a mating through aperture in the door, said housing means defining a peripheral flange which abuts one surface of the door adjacent the recess therein and having clamping means detachably secured thereto for abuting the opposite surface of the door to thereby tightly secure said housing means in said glass door, a generally L-shaped hinge arm secured to the furniture part and defining a hollow interior portion, pivot means for pivotally supporting said hinge arm relative to said housing means, a latch member pivotally supported in said interior portion and spring means also supported within said interior portion and resiliently urging said latch member in a first direction, and further means included within said housing means which latchingly engages said latch member when the door is moved to its closed position, said latch member being movable in an opposite direction against the action of said spring means as the door is moved to and from its closed condition thereby causing said further means to engage said latch member.

2. The hinge of claim 1 in which said spring means comprises a coil spring whose one end is supported adjacent said pivot means and whose other end is received within a mating recess defined in said latch member.

3. The hinge of claim 2 in which said one end of said spring fits over a guide pin which is supported on the axis of said pivot means perpendicularly to said axis.

4. The hinge of claim 1 in which said spring means comprises a hairpin spring having one portion thereof engaging with a recess in said latch member and a further portion supported within the hollow interior portion of said hinge arm.

5. The hinge of claim 4 in which said spring is of substantially U-shape with the bight portion thereof received within said recess and with its leg portions bearing against the inner surface of the hollow interior portion of said hinge arm.

* * * * *